US007677149B2

(12) United States Patent
Hogan et al.

(10) Patent No.: US 7,677,149 B2
(45) Date of Patent: Mar. 16, 2010

(54) COPING APPARATUS AND METHOD OF OPERATION

(76) Inventors: Thomas W. Hogan, 8924 Canyon Gate Rd., Sandy, UT (US) 84093; John M. Hogan, 8012 Lodgepole Dr., Sandy, UT (US) 84094

( * ) Notice: Subject to any disclaimer, the term of this patent is extended or adjusted under 35 U.S.C. 154(b) by 116 days.

(21) Appl. No.: 11/290,204

(22) Filed: Nov. 30, 2005

(65) Prior Publication Data

US 2006/0112800 A1 Jun. 1, 2006

Related U.S. Application Data

(60) Provisional application No. 60/631,739, filed on Nov. 30, 2004.

(51) Int. Cl.
*B26D 7/01* (2006.01)
*B26D 7/02* (2006.01)

(52) U.S. Cl. ..... 83/451; 83/467.1; 83/468.93; 83/792

(58) Field of Classification Search ..... 83/745, 83/813, 54, 581, 792, 451, 455, 457, 461, 83/466.1, 467.1, 468.8, 468.93, 389, 241; 409/92

See application file for complete search history.

(56) References Cited

U.S. PATENT DOCUMENTS

| | | | | |
|---|---|---|---|---|
| 3,245,296 | A * | 4/1966 | Valente | 83/162 |
| 3,452,630 | A | 7/1969 | Malm | |
| 3,584,529 | A | 6/1971 | Wallace | |
| 4,019,416 | A | 4/1977 | Krauss | |
| 4,494,428 | A | 1/1985 | Malof | |
| 5,027,518 | A | 7/1991 | Adomatis | |
| 5,103,702 | A * | 4/1992 | Yannazzone | 83/29 |
| 5,388,334 | A | 2/1995 | Halsey | |
| 5,669,296 | A * | 9/1997 | Newton | 100/99 |
| 6,550,365 | B1 | 4/2003 | Zhang et al. | |
| 6,615,712 | B2 * | 9/2003 | Faitel et al. | 100/269.2 |
| 6,736,037 | B2 | 5/2004 | Dean | |
| 2004/0211304 | A1 | 10/2004 | Dean | |

* cited by examiner

*Primary Examiner*—Ghassem Alie
(74) *Attorney, Agent, or Firm*—Morriss O'Bryant Compagni

(57) ABSTRACT

Embodiments of the present invention include a coping apparatus and method of operation that automates the process of forming coped butt joints on strips of molding for placement on internal wall angles that alleviates at least some of the problems associated with the use of miter joints or time consuming hand or powered coping using conventional coping saws.

6 Claims, 7 Drawing Sheets

COPING APPARATUS AND METHOD OF OPERATION

CROSS-REFERENCE TO RELATED APPLICATION

Pursuant to 35 U.S.C. § 119(e), this nonprovisional application claims benefit of priority to provisional patent application Ser. No. 60/631,739, filed Nov. 30, 2004, titled COPING APPARATUS AND METHOD OF OPERATION, the contents of which are herein incorporated by reference for all purposes as if fully set forth herein.

BACKGROUND OF THE INVENTION

1. Field of the Invention

The present invention relates generally to woodworking equipment. More particularly, this invention relates to a profiled cutter or coping apparatus and method of operation.

2. Description of Related Art

Molding used in the construction of residential and commercial properties provides a decorative finish to ceiling/wall interfaces, floor/wall interfaces and along walls at table or chair height in rooms. Molding may have a plain finish with a straight profile or it may be decoratively shaped with an elaborate profile using a machine for forming the profile, e.g., a shaper, a router or a molder.

Where two strips of molding join at an internal 90° angle, e.g., where two walls intersect, there are a couple of methods of joining the intersecting strips of molding. The first method is by forming a miter joint, i.e., at 45° angles, so that the respective patterns match together when joined at the 90° wall intersection. Miter joints work well for picture frames and also for external 90° wall intersections because when nailed or screwed together the miter joint is driven together. However, miter joints are not preferred for joining molding at internal 90° wall intersections. This is because when both sections of molding are nailed or screwed to the wall the miter joint tends to separate with each piece of molding moving toward the wall rather than toward the adjoining section of molding as the sections are affixed to the wall by nails or screws, leaving an unsightly gap.

The other conventional method of joining molding at an internal corner is to form a coped butt joint. Where the molding has a plain or straight profile, the sections of molding to be joined are merely cut on a 90° angle, with the first section affixed to its associated wall having its end resting against the adjoining wall. The second section is affixed to its associated wall and its end resting against the other section of molding. However, when the molding is profiled, it has been traditionally necessary to use a coping saw to properly hand cut the selected profile along the end of the second section of molding so that it will buff against the oppositely profiled first section of molding.

Those skilled in the art know that the formation of a coped butt joint using a coping saw for an ornate molding profile is a tedious and imprecise process of hand-cutting the end of the second section of molding. Even a skilled craftsman may find it difficult to precisely follow a template or profiled line with a coping saw to form the perfectly coped butt joint.

Various approaches to automating the coping process have been suggested in art. Some of the automated coping saws of the prior art are of the reciprocating blade variety. For example, see, U.S. Pat. No. 6,550,365 to Zhang et al. and U.S. Pat. No. 5,027,518 to Adomatis. In contrast, several of the automated coping saws of the prior art are of the endless blade variety. For example, see, U.S. Pat. No. 5,388,334 to Halsey, U.S. Pat. No. 6,736,037 and U.S. Patent Publication No. 2004/0211304, both to Dean. While these conventional coping saws all employ various means for powering the blade, thus, easing the effort required by the user to cope a piece of molding, they all still appear to require significant user skill in following a given pattern necessary to make an accurately coped butt joint. An additional drawback with the conventional automated coping saws is that coping many pieces of wood with a given pattern requires the user to follow a pattern for each cut. Thus, the lack of repeatability is a significant drawback of the conventional automated coping saws.

One type of device used to repeatedly cut thick objects, such as a stack of paper, is the hydraulic paper cutter. Examples of conventional hydraulic paper cutters may be found in U.S. Pat. No. 3,452,630 to Malm and U.S. Pat. No. 4,019,416 to Krause. Such hydraulic paper cutters employ shearing blades that cut stacks of paper along straight lines. However, such devices are unsuitable for coping a piece of wood because the required molding pattern is never a straight line. Hydraulic paper cutters are only capable of cutting a straight line and not a curved pattern. Hydraulic paper cutters are also not capable of cutting arbitrary coping patterns. Furthermore, the characteristics of a stack of paper are very different from a strip of molded wood under shearing conditions. For example, a strip of wood molding may have at least one surface that is not flat and thus could not be efficiently held down by hydraulic paper cutter shoes. Additionally, a strip of wood molding may inelastically compress and/or splinter when sheared, unlike a stack of paper.

For all of the above reasons, it would be desirable to have a more efficient automated method of forming coped butt joints that is repeatable and less subject to human error. Accordingly, there exists a need in the art for a coping apparatus and method of operation that automates the process of forming coped butt joints in strips of molding for internal wall angles typically about a 90° angle that alleviates the problems associated with the use of miter joints or the time consuming use of a coping saw.

BRIEF SUMMARY OF THE INVENTION

Embodiments of the apparatus and method of the present invention automate the process of forming coped butt joints for moldings placed on internal wall angles. The embodiments of the present invention alleviate at least some of the known problems associated with conventional approaches including the use of miter joints, the time consuming use of a hand coping saw and various automated coping saws of the prior art.

An embodiment of a coping apparatus for coping a strip of molding having a profile is disclosed. Coping apparatus may include a die configured with a negative profile forming a mirror-image of the profile of the strip of molding. Coping apparatus may further include a blade configured to match the profile of the strip of molding and to mate with the die. Coping apparatus may further include a shearing mechanism configured for selectively causing the blade to approach the die and thereby shear an end of the strip of molding to be cut between the die and blade, thereby forming a coped strip of molding.

An embodiment of a method of automatically coping a strip of molding with a profile is disclosed. The method may include providing a coping apparatus as described herein. The method may further include optionally precutting the strip of molding prior to shearing and optionally back undercutting the strip of molding prior to shearing. The method may further include inserting the strip of molding into the base form, securing the strip of molding to the die and shearing the strip of molding.

Additional features and advantages of the invention will be apparent from the detailed description which follows, taken in conjunction with the accompanying drawings, which together illustrate, by way of example, features of embodiments of the present invention.

BRIEF DESCRIPTION OF THE SEVERAL VIEWS OF THE DRAWINGS

The following drawings illustrate exemplary embodiments for carrying out the invention. Like reference numerals refer to like parts in different views or embodiments of the present invention in the drawings.

DETAILED DESCRIPTION OF THE INVENTION

Embodiments of the present invention include a coping apparatus and method of operation that automates the process of forming coped butt joints for molding placed on internal wall angles that alleviates at least some of the problems associated with the use of miter joints or the time consuming use of conventional coping saws. Molding used with the embodiments of the present invention may be formed of any suitable wood or other suitable composite or decorative architectural material according to embodiments of the present invention. Exemplary woods of which moldings may be formed and from which coped butt joints may be cut include, for example and not by way of limitation, softwoods such as cedar and pine, and hardwoods such as alder, poplar, oak, cherry, walnut, maple and mahogany according to embodiments of the present invention. Other suitable materials that may be cut using the apparatus and methods of the present invention include medium density fiberboard (MDF) and high density fiberboard (HDF) and other types of particle or fiberboard and veneered woods, plywood or fiberboard. The embodiments of the apparatus and methods of the present invention are particularly suited for a molding production environment where the molding is pre-cut and pre-coped to order at the molding manufacturer. However, it may be used anywhere that a coped butt joint needs to be formed including at a construction site.

Figure 1:
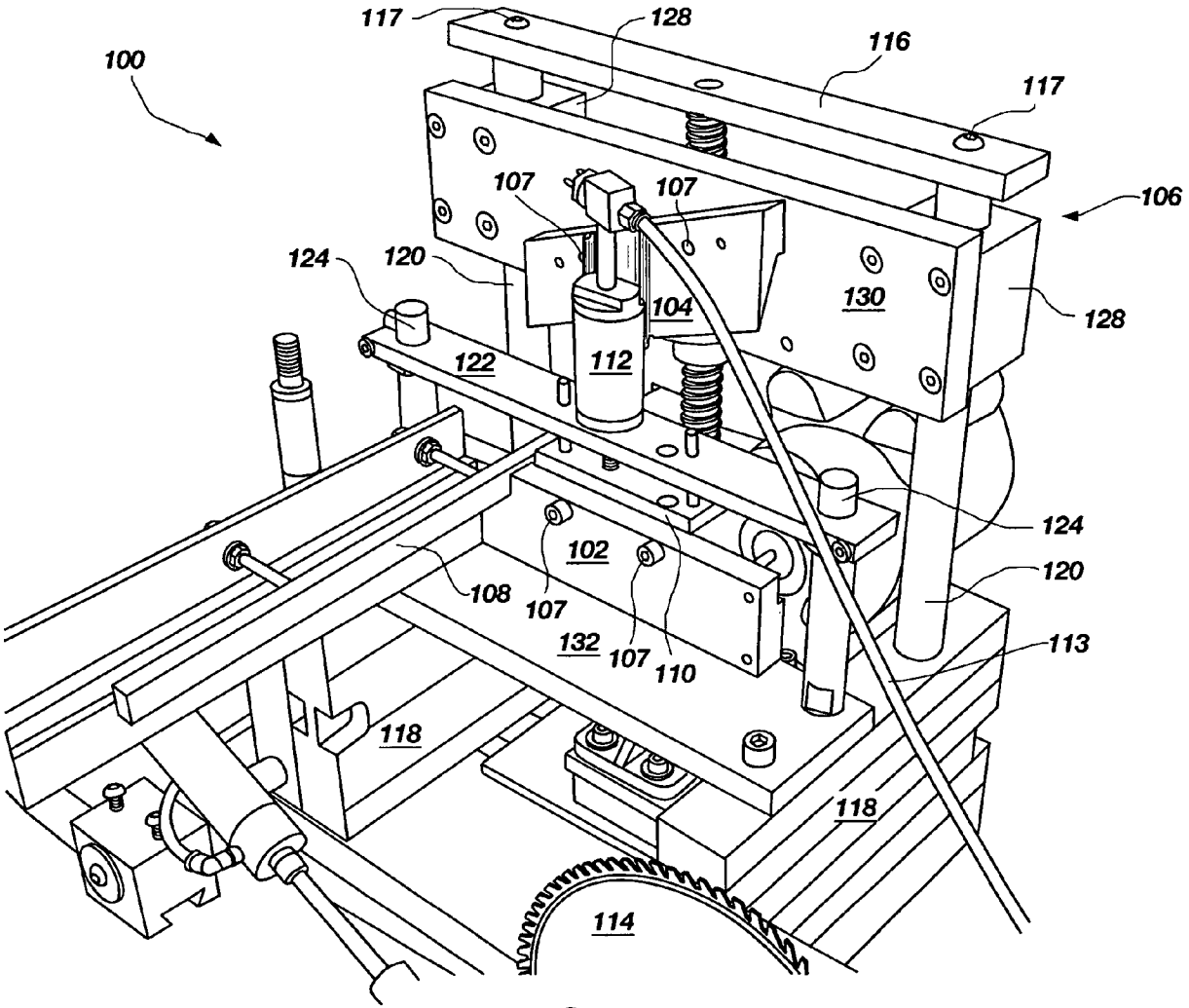
FIG. 1 is a front perspective view of an embodiment of coping apparatus according to the present invention.

FIG. 1 is a front perspective view of an embodiment of coping apparatus 100 according to the present invention. Coping apparatus 100 may include a base form 102 and a cutter assembly 106. Cutter assembly 106 may include a blade 104. Coping apparatus 100 may also include a guide rail 108 for guiding a section of molding into the base form 102. According to embodiments of the present invention, coping apparatus 100 may further include a pre-cut mechanism or back undercut mechanism, see for example saw blade 114 and further discussion below. Note that internal wall angles in a given building may vary anywhere from approximately 85° to approximately 95°, depending on the construction of the building or the result of the finishing the particular wallboard. For this reason, it is desirable to have a method or mechanism for adjusting the angle upon which the coping cut is formed in order to compensate for any internal wall angle, i.e., from approximately 85° to approximately 95°. According to one embodiment of the coping apparatus 100, the die 200 (see additional discussion below with regard to FIG. 2) may have its top edge ground to a predetermined angle in order to compensate for various internal wall angles that vary from the standard internal angle of 90°. The inventors are aware of no conventional coping saws or apparatuses that have this feature.

Base form 102 may further include a base plate 132 to which two steel side housings 118 are affixed, according to the embodiment of the coping apparatus 100 illustrated in FIG. 1. Base form 102 may further include a hold-down shoe 110 for pressing the section of molding against the base form 102 prior to, during and after cutting the section of molding. Base form 102 may further include an actuator 112 for automatically moving the hold-down shoe 110 against the section of molding to be cut. Actuator 112 may be pneumatic (as shown in FIG. 1), hydraulic (not shown) or any other mechanical means for pushing the hold-down shoe 110 against the section of molding, according to various embodiments of coping apparatus 100. An embodiment of coping apparatus 100 may also include a saw blade 114 for cutting the section of molding or for making pre-cuts (see 506 in FIG. 5 and discussion below) on the section of molding to be cut, according to the present invention. An embodiment of coping apparatus 100 may further include an outside guide fence (not shown) for pushing the section of molding to be cut against the guide rail 108 prior to, during and after cutting. The outside guide fence (not shown) minimizes splitting and splintering caused by the downward movement of the blade 104 of the cutter assembly 106 as it slices through the wood. Various mechanisms for implementing an outside guide fence that functions as described herein, such has clamps, spring loaded rails and the like, will be readily apparent to one of ordinary skill in the art and, thus, will not be further elaborated on herein.

Figure 2:
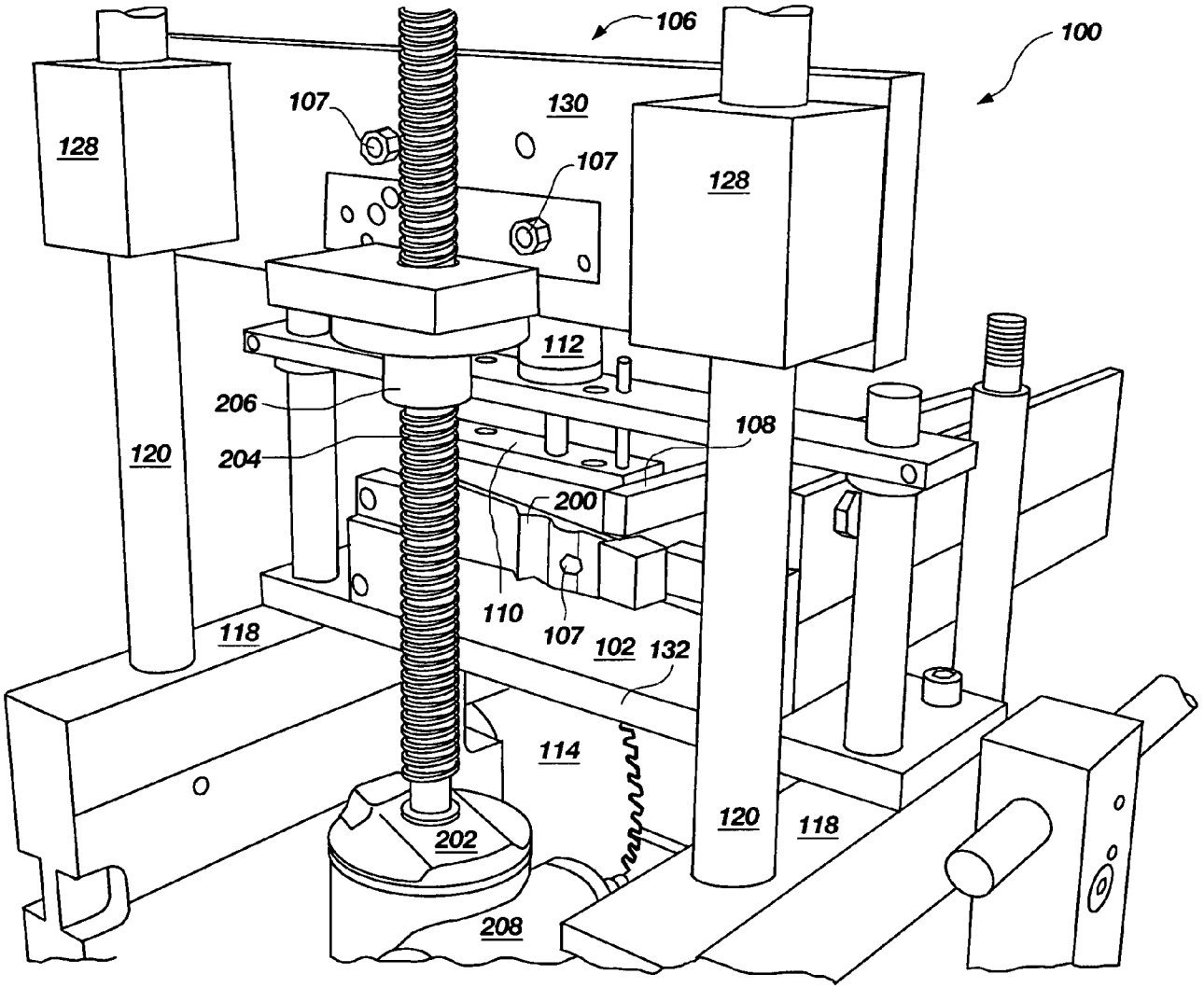
FIG. 2 is a left rear perspective view of the embodiment of the coping apparatus shown in FIG. 1.

FIG. 2 is a left rear perspective view of the embodiment of the coping apparatus 100 shown in FIG. 1. As shown in FIG. 2, base form 102 includes a die 200 configured with a desired negative profile for the pattern of the strip of molding, a cutter assembly 106, a guide rail 108, a hold-down shoe 110 and actuator 112. Note that the die 200 may be attached to the base form 102. Lateral adjustment of the blade 104 and/or die 200 may be provided to insure perfect alignment between the blade 104 and die 200 according to an embodiment of the present invention. The angled die 200 may be configured to mate with a back undercut (not shown in FIGS. 1 and 2, but see back undercut 506 in FIG. 5) formed in the end of the strip of molding to be cut (see 504B of FIG. 5) before it is cut by the blade 104. Back undercutting 506 reduces the amount of wood or other material that the blade must cut through during the cutting operation. Additionally, a "pre-trim" or "precut" of straight profiled portions of the strip of molding to be cut (504B of FIG. 5) may further reduce the amount of wood that must be sheared by coping apparatus 100 during the cutting operation.

Figure 3:
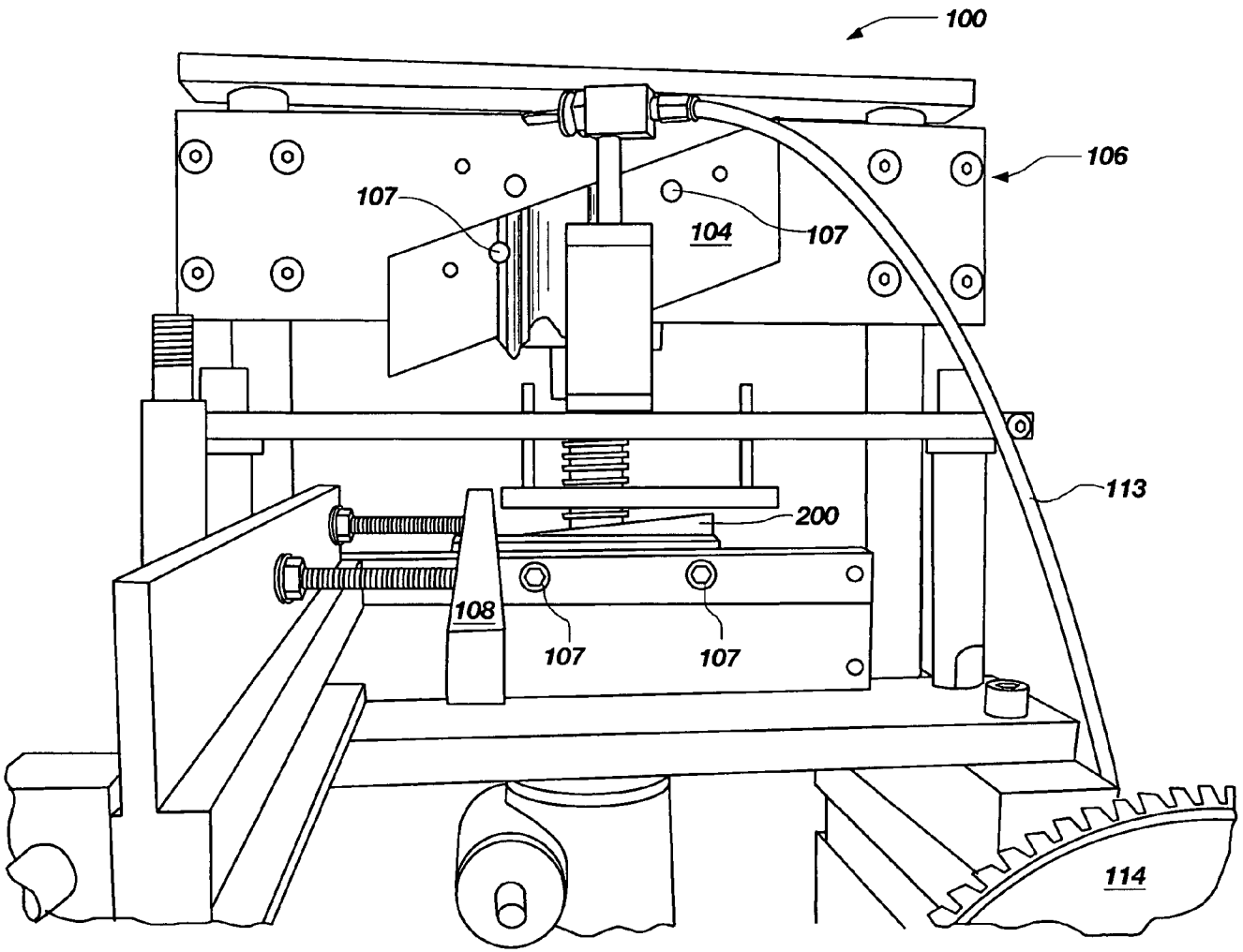
FIG. 3 is a front perspective view of the embodiment of the coping apparatus shown in FIG. 1.
Figure 4:
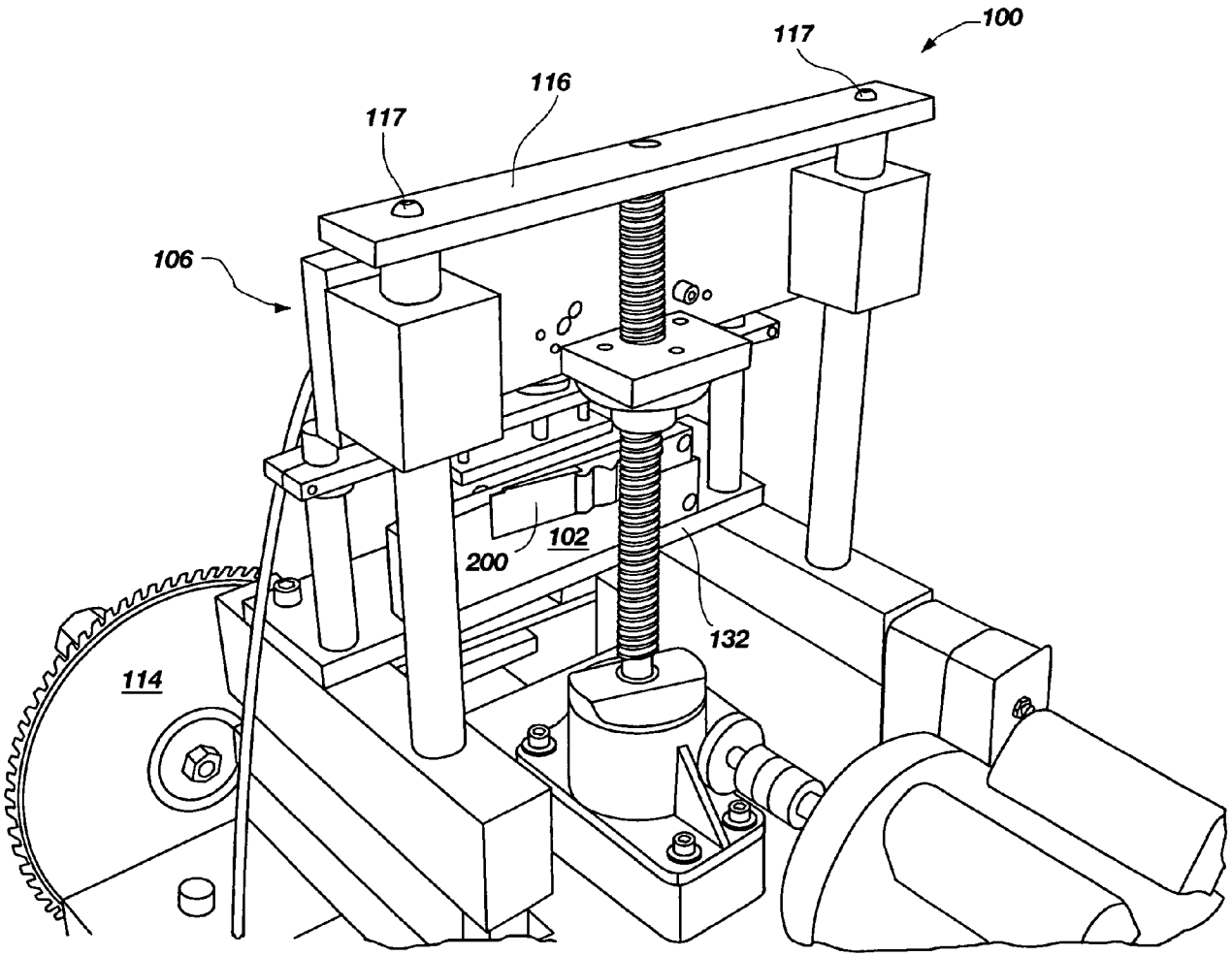
FIG. 4 is a right rear perspective view of the embodiment of the coping apparatus shown in FIG. 1.

FIG. 3 is a front perspective view of the embodiment of the coping apparatus 100 shown in FIG. 1. The cutter assembly 106 with blade 104 is shown in a raised position. FIG. 4 is a right rear perspective view of the embodiment of the coping apparatus 100 shown in FIG. 1.

Referring again to FIGS. 1 and 2, hold-down shoe 110 may have a flat bottom surface configured for pressing down against the top of a selected section or piece of molding (not shown in FIGS. 1 and 2). According to yet another embodiment of coping apparatus 100, hold-down shoe 110 may have a contoured bottom surface (not shown in the embodiment of FIGS. 1 and 2). The contoured bottom surface may be configured to match the selected profile of the molding to be cut (504B of FIG. 5). This embodiment of hold-down shoe 110 may prevent the formation of indentations in the material of the strip of molding to be cut (504B of FIG. 5) during holding and cutting operations.

Cutter assembly 106 may further include a shearing mechanism for causing the cutter assembly 106 to collapse on the die. As shown in FIGS. 1 and 2, the shearing mechanism may be a screw actuator 202. Other embodiments of the coping apparatus 100 may include a cutter assembly 106 having a shearing mechanism formed of hydraulic, pneumatic, mechanical, or any suitable shearing mechanism consistent with the teachings of the present invention. Shearing mechanism may comprise linear motion according to an embodiment of the present invention.

According to another embodiment of a coping apparatus 100, the relative positions of the guide rail 108, base form 102, die 200 and cutter assembly 106 may be reversed to make a cut in the left end of the strip of molding. FIGS. 1-2 illustrate cutting the right end of a strip of molding. Generally, when installing molding, a carpenter will generally continue in either a clockwise direction or counterclockwise direction until the room is completed.

Referring to FIGS. 1 and 2, generally, the coping apparatus 100 may include a base form 102 with two steel side housings 118. Each of the steel side housings 118 may include a vertical shaft 120, for example 1 ½" diameter shaft, extending vertically up and out of each one of these steel side housings 118. These shafts 120 guide the cutter assembly shown generally at 106 comprised of a backing plate 130, a bushing housing 128 including a bushing (not shown for clarity) on each side as well as blade 104 mounted to a face of backing plate 130. This cutter assembly 106 may be raised and lowered relative to the die 200 by means of a shearing mechanism, such as the rotating screw 204 shown in FIG. 2. This rotating screw 204 may be mounted behind the cutter assembly 106 so as to be out of the way of the cutter assembly 106. The rotating screw 204 may be part of an assembly called a screw actuator 202, which may be preassembled and purchased as a separate unit for assembly into the coping apparatus 100 according to an embodiment of the present invention. According to this embodiment, a screw nut 206 moves up and down along this rotating screw 204. Operatively coupled to this screw actuator 202 is a motor 208 which powers the rotating screw 204. According to this embodiment of coping apparatus 100, the motor 208 rotates the screw 204 and, thus, the cutter assembly 106 raises and lowers according to the direction of rotation.

According to an embodiment of the coping apparatus 100, the cutter assembly 106 may include a top plate 116 that mounts on top of two parallel steel side housings 118. Mounting holes and bolts 117 in top plate 116 are set at a proper width apart so that the cutter assembly 106 will not bind from misalignment. The embodiment of a coping apparatus 100 illustrated in FIG. 1 also includes two upright shafts 120 that secure top plate 116 from moving and also extend upright at right angles from each steel side housing 118. The shafts 120 may extend upward through holes in each steel side housing 118 for the purpose of adjustment up and down and also for permanent securing to steel side housing 118, according to an embodiment of the present invention. In another embodiment, the shafts 120 may be bolted to the steel side housings 118. Of course, other means of securing the shafts 120 to steel side housings 118 will be readily apparent to those skilled in the art and are considered within the scope of the present invention.

The embodiment of a coping apparatus 100 illustrated in FIG. 1 may further include two more upright shafts 124 that support a horizontal piece of steel called a hold-down assembly 122. The hold-down assembly 122 may include a bar of steel ½" thick and 2" wide, and having a length appropriate for the base form 102. Approximately in the middle of this hold-down assembly 122 is fastened an actuator 112. Actuator 112 selectively drives the hold-down shoe 110 against the strip of molding to hold it in place prior to, during and after cutting. Actuator 112 may be a pneumatic air cylinder as illustrated in the embodiment of FIG. 1. Alternatively, actuator 112 may be hydraulic or some other mechanical actuator according to other embodiments of the present invention. In the embodiment illustrated, the pneumatic air cylinder may be pressurized with compressed air supplied by an air compressor (not shown) via a hose 113. When air is supplied from the compressor, the piston of this pneumatic air cylinder presses the hold down shoe 110 downward on top of the strip of molding and holds it from moving. The pneumatic air cylinder may be appropriately sized and specified to perform the task of holding the strip of molding as known to those skilled in the art. The pneumatic air cylinder illustrated in FIG. 1, for example, may be specified for a minimum of approximately 170 lbs. per square inch. There may also be a table or other flat surface (not shown in FIGS. 1-2) under the strip of molding for supporting the strip of molding during the coping process.

Guide rail 108 may be formed of a piece of metal approximately ½x¾ with 2 holes drilled at each end so that a screw can be put through the holes to secure it to a fixed side rail which is mounted onto the base form 102. According to another embodiment of coping apparatus 100, guide rail 108 may be precisely adjusted using adjustment screws or other means (as shown in FIGS. 1 and 3) to accommodate lateral adjustment of the strip of molding relative to the die 200. According to yet another embodiment of the present invention, base form 102 may include another adjustment mechanism (not shown) that is configured to allow precise alignment between the cutter assembly 106 blade 104 and the die 200. Such adjustment mechanisms are within the knowledge of one of ordinary skill in the art and, thus, will not be further elaborated on herein.

Guide rail 108 may be mounted to a steel side housing 118 which may in turn be mounted to the base plate 132. Die 200 is configured for adjustable mounting on the base plate 132, thus, allowing alignment with the cutter assembly 106 blade 104. The base plate 132 supports die 200. Die 200 is configured with an exact negative profile or shape of blade 104. Blade 104 and die 200 may be electrical discharge machined (EDM) according to an embodiment of the present invention. Alternatively, the blade 104 and the die 200 may be ground to an exact profile shape as desired according to another embodiment.

Proper alignment of the blade 104 relative to die 200 is necessary for an accurate coping cut. According to an embodiment of coping apparatus 100, blade 104 and die 200 may be manually aligned, for example, by one or more mounting bolts 107 (as shown in FIGS. 1-3), by lowering the cutter assembly 106 to the level of the die 200 mounted on the base plate 132 and then adjusting the mounting bolts 107. The mounting holes in the base form 102 or base plate 132 may be slotted or widened so that the die 200 may be adjusted until perfectly aligned and then the mounting bolts 107 are tightened. After the die 200 is tightened to the base plate 132, the entire base plate 132 which mounts on top of the side steel housings 118 may be adjusted toward or away from the cutter assembly 106 to allow the proper space between the blade 104 and the die 200. According to one embodiment of the present invention, the spacing between the blade 104 and the die 200 is not more than 0.002 thousandths of an inch, but is adjustable to accommodate any suitable spacing desired.

Other embodiment of the present invention may include drilled and tapped holes placed in the steel side housings 118 and the base plate 132 configured with slotted holes according to various embodiments. Such embodiments allow the base plate 132 to be adjusted toward or away from the cutter assembly 106 to accommodate a perfect fit alignment. In yet another embodiment of the coping apparatus 100, "jack" screws may be set on top of the steel side steel housings 118 in a position such that they can be screwed in or out to make a positive adjustment with the use of a wrench. This will allow easy micro adjustments to be made to the base plate 132, thus, assuring that the base plate 132 holds the die in perfect alignment without moving unless needed.

Another embodiment of a coping apparatus 100 for coping a strip of molding having a profile is disclosed. The embodiment of coping apparatus 100 may include a die 200 configured with a negative profile forming a mirror-image of the profile of the strip of molding. Coping apparatus 100 may further include a blade 104 configured to match the profile of the strip of molding and to mate with the die 200. Coping apparatus 100 may further include a shearing mechanism configured for selectively causing the blade 104 to approach the die 200 and thereby shear an end of the strip of molding to be cut between the die 200 and blade 104, thereby forming a coped strip of molding. According to yet another embodiment of coping apparatus 100, the die 200 may be adjustably mounted to a base form 102. According to another embodiment of coping apparatus 100, the blade 104 may be adjustably mounted to the cutter assembly 106.

According one embodiment of coping apparatus 100, the shearing mechanism may include a hydraulic press. According to another embodiment of coping apparatus 100, the shearing mechanism may include a motor driving a screw actuator 202 which drives a rotating screw 204. According to yet another embodiment of coping apparatus 100, the shearing mechanism may be configured for linear movement.

According to still another embodiment, the coping apparatus 100 may further include a hold down shoe 110 configured to secure the strip of molding against the die 200. According to still a further embodiment of the coping apparatus 100, the hold down shoe may be configured with a bottom surface having a contoured bottom surface configured to mate with and push the strip of molding against the die 200. According to another embodiment, the coping apparatus 100 may further include a guide rail 108 configured for aligning the strip of molding relative to the die 200.

According to still another embodiment, the coping apparatus 100 may further include a precut mechanism, such as a saw blade 114. According to yet another embodiment, the coping apparatus 100 may further include a back undercutting mechanism, such as a saw blade 114. According to another embodiment of coping apparatus 100, the die and/or the blade may be formed of A2 tool steel.

Figure 5:
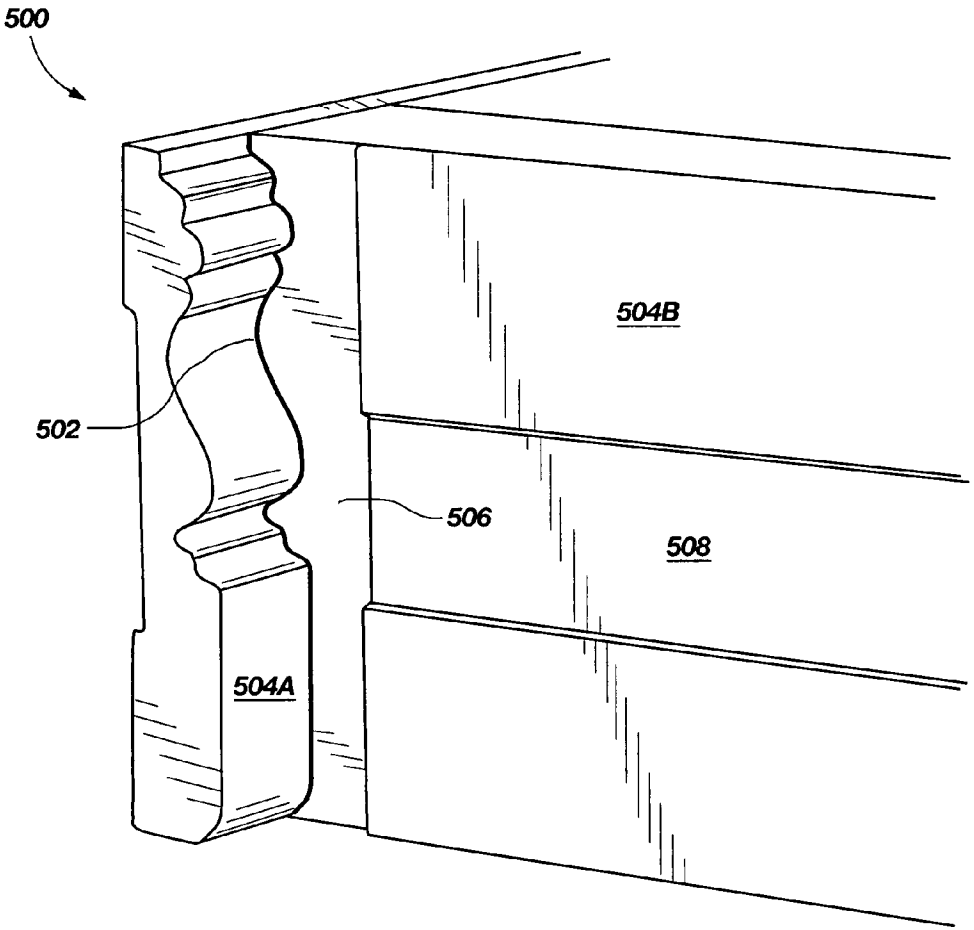
FIG. 5 is a diagram of an exemplary coped butt joint formed using the embodiment of the coping apparatus shown in FIG. 1.

FIG. 5 is an exemplary coped butt joint 500 viewed from the backside of the strip of molding cut using an embodiment of the coping apparatus 100 shown in FIG. 1. The coped butt joint 500 includes a first strip of molding 500A cut at right angles and the strip of molding to be coped 504B. The strip of molding to be cut or coped 504B has a particular profile 502 associated with the style of molding. However, as noted herein, the die 200 and blade 104 of the coping apparatus 100 may have any arbitrarily selected profile according to embodiments of the present invention. Note that most molding, especially floorboards will have one or more indentations or relief cuts 508 running laterally along the back side of the strip of molding. For example, see the single indentation 508 running parallel to the length of the strip of molding shown in FIG. 5.

As the blade 104 must cut through the entire thickness of the strip of molding, it is advantageous to back undercut 506 the strip of molding to be cut 504 before cutting it to butt against the opposite strip of molding. FIG. 5 illustrates the back undercut 506 feature of the coping apparatus 100. Undercutting may be performed by a saw blade (114, see FIGS. 1-4) to result as shown in FIG. 5, or may alternatively be performed by removing portions of the backside of the strip of molding using any suitable means such as routing or chiseling. Portions of molding profiles may have region that are not ornately profiled, i.e., generally straight. To increase the longevity and maintain the sharpness of the blade 104 and die 200 of coping apparatus 100, it may also be advantageous to precut the straight portion of the strip of molding with a saw blade.

Yet another embodiment of the coping apparatus 100 of the present invention may include angling the cut of the blade so that the outer profile of the coped butt joint has a sharper edge (less than 90° angle) for mating against the opposite strip. This embodiment provides a tighter coped butt joint than one which is been cut at a 90° angle. This embodiment may be accomplished by lowering from about 2° to about 5° the end of the strip of molding that is being cut. Yet another advantage may be obtained by cutting the length of the strip of molding approximately 1/16" longer than required. This will insure a tighter fit to the adjacent strip of molding and provide a more aesthetic appearing coped butt joint.

The blade 104 and die 200 may be formed of A2 tool steel, that has been annealed to allow the metal to be machined. The blade 104 and die 200 may then be rough shaped, hardened and then electrical discharge machined (EDM) according to a preselected computer aided design (CAD) profile for the selected molding profile. Of course, other suitable means of forming or obtaining the blade 104 and die 200 for coping apparatus 100 are also considered within the scope of the present invention as well as other types of tool steel.

Figure 6:
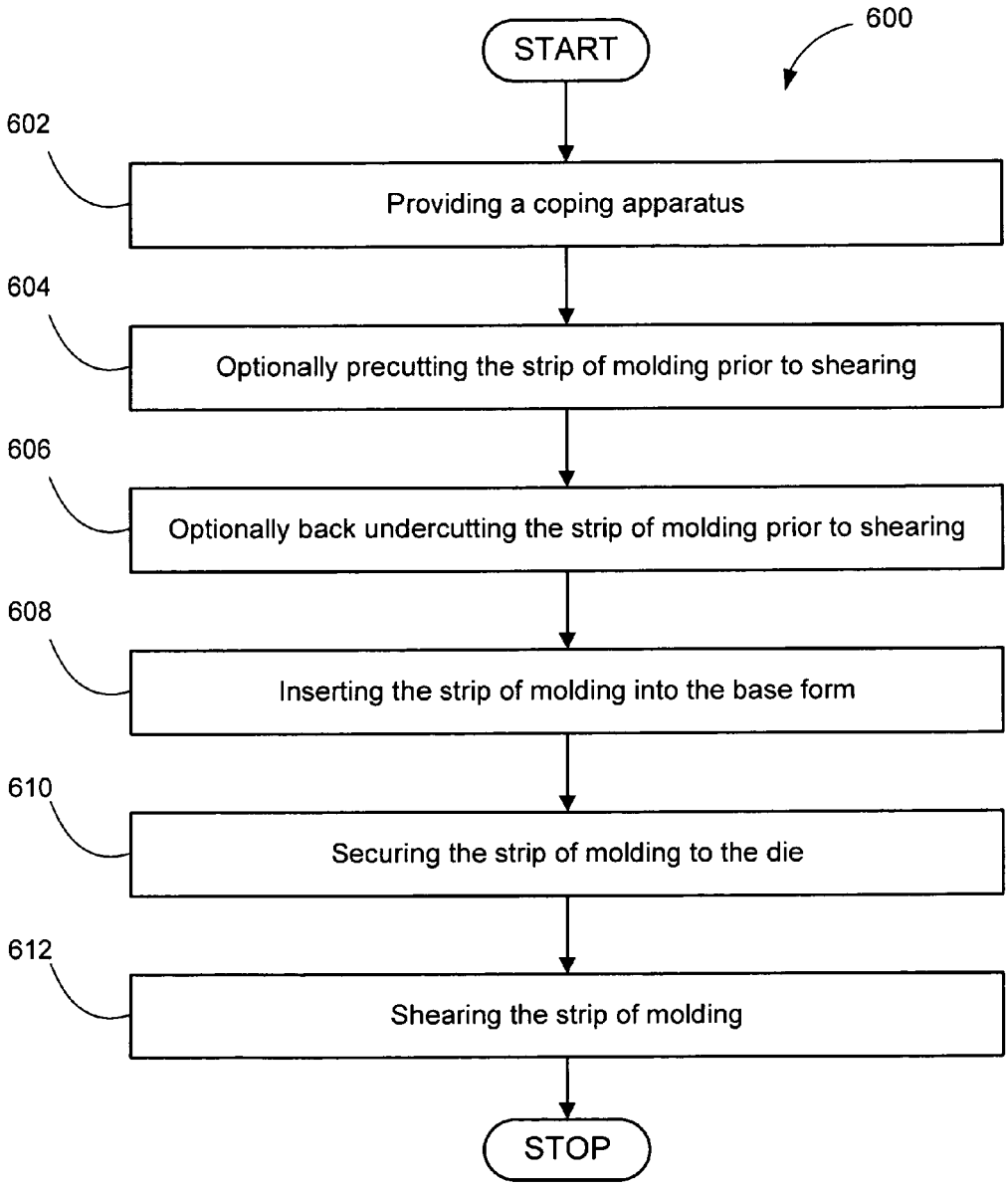
FIG. 6 is a flow chart of an embodiment of a method of automatically coping a strip of molding with a profile according to the present invention.

FIG. 6 is a flow chart of an embodiment of a method 600 of automatically coping a strip of molding with a profile is disclosed. Method 600 may include providing 602 a coping apparatus as described herein. Method 600 may further include optionally precutting 604 the strip of molding prior to shearing 612. Method 600 may further include optionally back undercutting 606 the strip of molding prior to shearing 612. Method 600 may further include inserting 608 the strip of molding into the base form. Method 600 may further include securing 610 the strip of molding to the die and shearing 612 the strip of molding. The resulting coped molding may be used to form a complete coped butt joint. One simply takes another strip of molding that has been cut at a 90° on one end and trimmed to length on the other end, secure it against one side of an inner corner wall, and then secure the coped molding on top of the first strip of secured molding after matching profiles.

Figure 7:
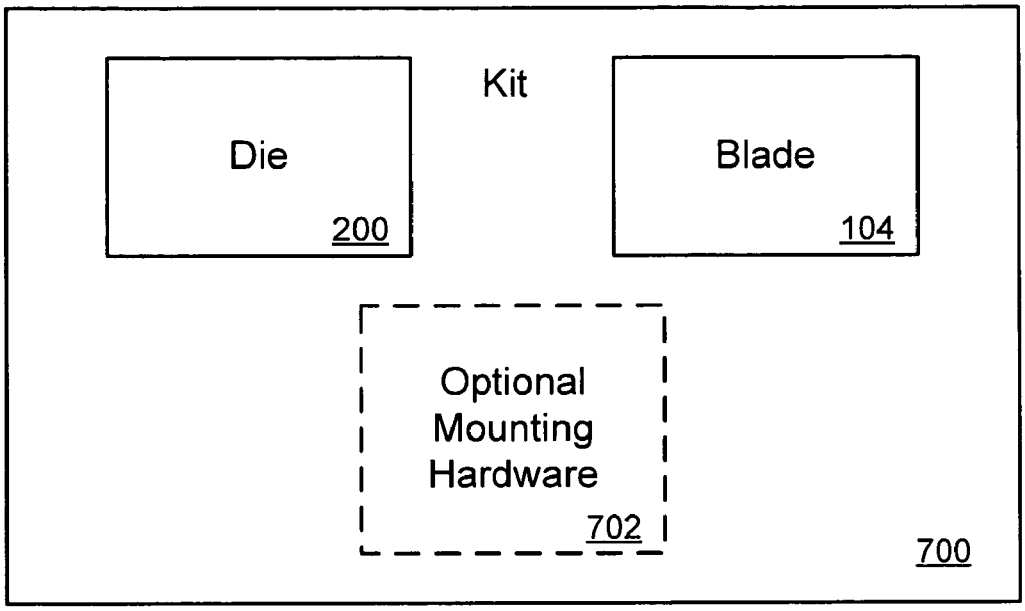
FIG. 7 is a block diagram of an embodiment of an embodiment of a die and blade kit for use in a coping apparatus according to the present invention.

FIG. 7 is a block diagram of an embodiment die and blade kit 700 for use in a coping apparatus 100 as described herein. Kit 700 may include a die 200 configured with a negative profile forming a mirror-image of the profile of the strip of molding. Kit 700 may further include a blade 104 configured to match the profile the strip of molding and to mate with the die. Kit 700 may optionally include mounting hardware 702 (shown in dotted line). Mounting hardware may include bolts washers or any other suitable hardware for mounting the die 200 and/or blade 104 to a coping apparatus 100 as described herein. According to embodiments of kit 700 the die 200 and the blade 104 each may be configured with mounting holes (nor shown in FIG. 7) for assembling on the coping apparatus 100. According to another embodiment of kit 700, the die 200 and the blade 104 may each be formed of any suitable tool steel, for example and not by way of limitation, A2 tool steel. However, any suitable hardened material may be used to form the die 200 and/or blade 104 of the present invention, for example and not by way of limitation, carbide steel, graphite and ceramic materials. As there are potentially infinite molding profiles, commercially available and that could be created, various embodiments of kit 700 are each contemplated to be configured for coping any one of a plurality of molding profiles according to the present invention.

While the foregoing advantages of the present invention are manifested in the illustrated embodiments of the invention, a variety of changes can be made to the configuration, design and construction of the invention to achieve those advantages. For example, certain features have been described individually and may all be combined in a single machine that automatically pre-trims, back undercuts and shears the selected profile for the coped butt joint. Hence, reference herein to specific details of the structure and function of the present invention is by way of example only and not by way of limitation.

What is claimed is:

1. A coping apparatus for coping a strip of molding, the strip of molding having an arbitrary non-linear profile as traced along an outer surface of the molding when viewed in cross-section, the coping apparatus comprising:

a die configured with a die mounting surface, a die face parallel to the mounting surface, a die top surface extending from the die mounting surface to the die cutting surface, and a die cutting edge along the die top surface where said die cutting edge intersects the die cutting surface;

the die face further comprising a negative arbitrary non-linear profile as viewed in cross-section;

a base form configured for receiving the die mounting surface and adjustably mounting the die in a fixed position, the base form further configured for receiving and supporting an inner surface of an end of the strip of molding to be coped, the end of the strip of molding supported above and extended over the die;

a blade configured with a blade mounting surface, a blade face parallel to the blade mounting surface, a blade bottom surface extending between the blade mounting surface and the blade cutting surface, and a blade cutting edge along the blade bottom surface where said blade cutting edge intersects the blade cutting surface;

the blade face further comprising the arbitrary non-linear profile of the strip of molding as viewed in cross-section;

a cutter assembly configured for receiving the blade mounting surface and for mounting the blade such that the blade face is configured to pass flush against the die face during a coping operation; and a shearing mechanism mounted to the base form and the cutter assembly, the shearing mechanism configured to selectively cause the blade cutting edge to approach the outside surface of end of the strip of molding with long axis perpendicular to the die and blade faces, thereby causing the blade cutting edge to pass through the end of the strip of molding and blade face to pass flush against the die face during the coping operation, thereby imparting the arbitrary non-linear profile to the end of the strip of molding and forming a coped end in the strip of molding.

2. The coping apparatus according to claim 1, wherein the shearing mechanism comprises a motor driving a screw actuator which drives a rotating screw.

3. The coping apparatus according to claim 1, wherein the shearing mechanism is configured for linear movement.

4. The coping apparatus according to claim 1, further comprising a hold down shoe mounted to the base form for selectively receiving and holding the end of the strip of molding against the base form and extended over the die top surface.

5. The coping apparatus according to claim 1, wherein the coped end of the strip of molding will butt perpendicularly and flush against the outer surface of another strip of molding having an identical arbitrary non-linear profile.

6. The coping apparatus according to claim 1, wherein the coped end in the strip of molding comprises recesses and protrusions that allow the end to butt perpendicularly and flush against the outer surface of another strip of molding having the arbitrary non-linear profile.

* * * * *